United States Patent [19]

Yoneya

[11] 4,042,735

[45] Aug. 16, 1977

[54] CARPET CONSTRUCTION

[75] Inventor: Kiyoo Yoneya, Kurobe, Japan

[73] Assignee: Yoshida Kogyo Kabushiki Kaisha, Japan

[21] Appl. No.: 724,650

[22] Filed: Sept. 20, 1976

[30] Foreign Application Priority Data

Sept. 30, 1975 Japan ..... 50-134214

[51] Int. Cl.[2] ..... D04H 11/00

[52] U.S. Cl. ..... 428/33; 428/62; 24/205.1 C

[58] Field of Search ..... 16/4, 8, 16, 7; 49/460; 52/467; 24/205.1 C, 205.1 R; 428/17, 33, 57, 62, 99, 101, 122, 129

[56] References Cited

U.S. PATENT DOCUMENTS

| | | | |
|---|---|---|---|
| 1,576,527 | 3/1926 | McBride | 296/29 |
| 2,104,941 | 1/1938 | Baynton et al. | 428/95 X |
| 2,116,846 | 5/1938 | Pilcher | 52/312 |
| 2,385,816 | 10/1945 | Krupp | 24/205.1 R |
| 2,552,114 | 5/1951 | Reinhard | 428/62 |
| 2,996,751 | 8/1961 | Roby et al. | 16/16 X |
| 3,411,977 | 11/1968 | Slater, Jr. | 428/33 |

*Primary Examiner*—Marion E. McCamish
*Assistant Examiner*—Henry F. Epstein
*Attorney, Agent, or Firm*—Bucknam and Archer

[57] ABSTRACT

A carpet construction comprises a pair of sheet materials having their opposed ends disposed in abutting engagement with each other. A sliding clasp fastener having a pair of stringer tapes carrying along their longitudinal edges rows of interengageable elements is provided for jointing the sheet materials together, the stringer tapes being attached to the reverse surfaces of the sheet materials immediately adjacent to the abutting ends thereof. A protective member extends along the length of the sliding clasp fastener and covers the coupled rows of fastener elements so as to prevent foreign matters from entering the spaces between the fastener elements. The protective member has means for preventing the coupled rows of fastener elements from displacement in a direction transverse to the longitudinal axis of the sliding clasp fastener.

5 Claims, 3 Drawing Figures

CARPET CONSTRUCTION

BACKGROUND OF THE INVENTION

1. Field of the Invention

This invention relates generally to the art of jointing sheet materials end to end and more particularly to a carpet construction provided with such a joint structure having a sliding clasp fastener.

2. Prior Art

It has been known in the art to butt-joint sheet materials by means of a sliding clasp fastener to provide a carpet or similar covering article, the sliding clasp fastener having a pair of stringer tapes each carrying along its inner longitudinal edge a row of interengageable fastener elements, and the stringer tapes being secured to reverse surfaces of opposed sheet materials adjacent to the abutting ends thereof whereby the adjacent sheet materials are butt-jointed together by closing the sliding clasp fastener by a slider movable along the fastener elements.

Such conventional joint structures have the disadvantage, however, that the coupled stringer tapes ae oftentimes subjected to disengagement or mismeshing over a prolonged period of time. This difficulty arises out of the fact that these conventional joint structures were not provided with means for covering the coupled fastener elements to prevent foreign matters such as dust, dirt and grit from entering the spaces between the coupled fastener elements, which would in turn reduce the coupling strength of the fastener elements. This problem is serious particularly where these prior art joint structures are employed to butt-joint a plurality of sheet materials to provide a covering article for use outdoors such as a sheet of artificial lawn which is usually laid over the ground when the aforesaid foreign matters tend to adversely affect the manipulation of the slider to open and close the fastener and reduce the coupling strength of the fastener elements. Another disadvantage of such conventional joint structures is that they have not had any means for positively preventing the coupled fastener elements from moving in a direction transverse to the longitudinal axis of the sliding clasp fastener, which has further resulted in premature malfunction of the sliding clasp fastener.

SUMMARY OF THE INVENTION

It is therefore an object of this invention to provide a carpet construction having a joint structure which has means for ensuring that the butt-jointing of the sheet materials is positively protected against impairment.

According to the invention, there is provided a carpet construction comprising: a pair of sheet materials having their opposed ends disposed in abutting engagement with each other; a pair of undercushioning members secured respectively to reverse surfaces of said sheet materials, said undercushioning members terminating short of said abutting ends to provide a longitudinal recess therebetween; a sliding clasp fastener having a pair of stringer tapes carrying along their inner longitudinal edges rows of interengageable fastener elements, said stringer tapes being secured to the reverse surfaces of said sheet materials immediately adjacent to the abutting ends thereof, said rows of fastener elements being coupled together, and said coupled rows of fastener elements being located in said longitudinal recess; and a protective member extending along the length of said sliding clasp fastener and covering said coupled rows of fastener elements, and said protective member having a longitudinal groove snugly receiving said coupled rows of fastener elements therein, thereby preventing the same from displacement in a direction transverse to the longitudinal axis of said sliding clasp fastener.

Many other advantages and features of the present invention will become manifest to those versed in the art upon making reference to the detailed description and the accompanying sheet of drawings in which preferred structural embodiments incorporating the principles of the present invention are shown by way of example.

DETAILED DESCRIPTION OF THE PREFERRED EMBODIMENTS

Figure 1:
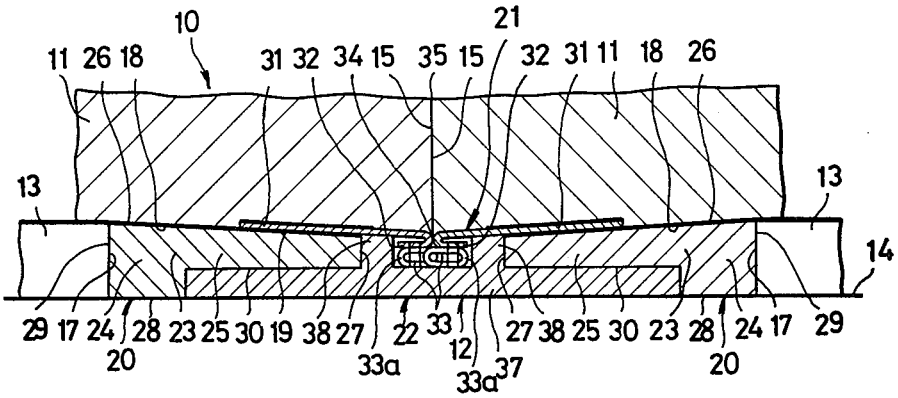
FIG. 1 is a vertical cross-sectional view of a portion of a carpet or similar covering article comprising a pair of fabrics, showing a joint structure according to the invention installed at the joint of the fabrics.

FIG. 1 partially shows a pile carpet or like covering article 10 comprising at least two napped fabrics 11,11 which are butt-jointed together by a joint structure 12 according to the invention. Each of the fabrics 11,11 has a sheet of undercushioning material 13 secured to its reverse surface and laid over a floor 14, the under-cushioning members 13,13 terminating short of the abutted ends or edges 15,15 of the fabrics 11,11 so that the opposed ends 17,17 of the under-cushioning members 13,13 and the lower marginal edges 18,18 of the fabrics 11,11 define a longitudinal recess 19 when the fabrics 11,11 are butt-jointed together.

The joint structure 12 comprises a pair of attachment members 20,20 a sliding clasp fastener 21, and a protective member 22, both of the attachment members and the protective member 22 being made of an elastomeric material such as polyvinyl chloride or synthetic rubber.

Each of the attachment members 20,20 is disposed in the longitudinal recess 19 and includes a body 23 having a base 24 of generally square cross section and a projection 25 of generally rectangular cross section formed integrally with and extending from the base 24 toward the fabric end or edge 15 such that the base 24 and the projection 25 jointly provide a planar upper surface 26 which is slightly slanted downwardly toward its distal end or edge 27 and is mated with and adhesively secured to the marginal edge 18 of the fabric 11, the body 23 extending longitudinally along the length of the fabric 11. The undersurface 28 of each base 24 lies flush with that of the under-cushioning member 13 and is held against the floor 14, the opposite end or edge 29 of the body 23 which is the side of the base 24 is mated with and adhesively secured to the confronting end 17 of the cushioning member 13. The vertical thickness of each of the projections 25,25 is less than that of each base 24 such that the base 24 and the projection 25 jointly provide a stepped lower surface to form a longitudinal depression 30 extending along the length of the attachment member 20, part of the stepped surfaces being constituted by the undersurface 28 of the base 24.

The sliding clasp fastener 21 is of the concealed type and has a pair of stringer tapes 31,31 carrying along their inner longitudinal folded edges 32,32 rows of interengageable fastener elements 33 which are taken into mutual engagement by movement of a slider (not shown) along the fastener elements 33 to close the sliding clasp fastener 21. Each of the stringer tapes 31,31 is sandwiched between and adhesively bonded to the fabric 11 and the attachment member 20 as shown in the drawings with the abutting line 34 intermediate the opposed stringer tapes 31,31 in registry with the joint line 35 along which the adjacent fabrics 11,11 are butt-jointed together, the stringer tapes 31,31 extending along the marginal edges 18,18 of the respective fabrics 11,11 closely adjacent to their ends or edges 15,15. The projections 25,25 terminate short of the joint line 35 to position the coupled rows of fastener elements 33 between the opposed ends or edges 27,27 such that a pair of longitudinal spaces 36,36 are provided on opposite sides of the coupled fastener elements 33. As shown in the drawings, the pair of attachment members 20,20 as well as the pair of stringer tapes 21,21 are disposed symmetrically both with respect to the abutting line 34 and the joint line 35.

The protective member 22 comprises an elongaged plate member 37 having a pair of ridges 38,38 of generally square cross section formed on one surface thereof and extending the full length thereof to form a longitudinal groove 39 therebetween, the pair of ridges 28,28 being spaced equidistant from the central longitudinal axis of the protective plate member 37 so that the protective plate member 27 is symmetrical with respect to the central longitudinal axis thereof. The protective member 22 is attached to and retained in position by the attachment members 20,20 with the pair of ridges 38,38 received in the longitudinal spaces 36,36 and with the coupled fastener elements 33 in turn received in the groove 39, the lateral portions 40,40 of the protective member 22 which extend from the ridges 38,38 and are directed away from each other being received ih the respective depressions 30,30, and the opposite sides 41,41 of the ridges 38,38 frictionally engaging the ends or edges 27,27 of the attachment members 20,20 respectively. As shown in FIG. 1, the top faces of the ridges 38,38 are held in abutting engagement with the under-surfaces of the stringer tapes 31,31 immediately adjacent to the coupled fastener elements 31, and the under-surface of the protective member 22 lies flush with those of the bases 24,24 and is held against the floor 14.

Figure 2:
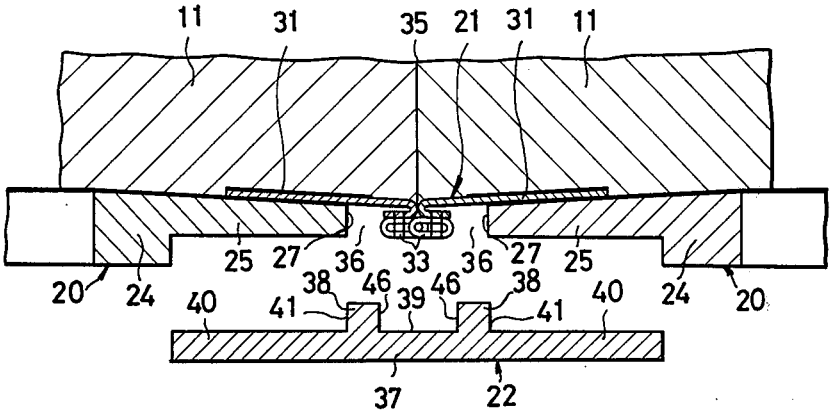
FIG. 2 is a view similar to FIG. 1 but showing a protective member just before it is assembled in position in the joint structure.
Figure 3:
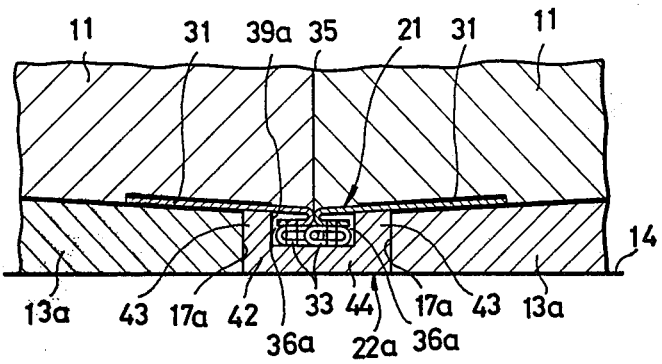
FIG. 3 is a view similar to FIG. 1 but showing another joint structure having a modified protective member.

A modified form of the invention is shown in FIG. 3 in which the need for the attachment members 20,20 of the first embodiment shown in FIGS. 1 and 2 is obviated by the provision of an undercushioning member 13a secured to the reverse surface of each of the fabrics 11,11, the under-cushioning members 13a,13a having their opposed ends or edges 17a,17a disposed adjacent to the joint line 35 to position the coupled rows of fastener elements 33 therebetween in spaced relationship thereto to provide a pair of spaces 36a,36a on oppsite sides of the coupled fastener elements 33. A protective member 22a includes a body 42 of a channel-shaped cross section having a pair of opposed arms 43,43 and a base 44 interconnecting the arms at one of their ends to form a longitudinal groove 39a. The protective member 22a is of such a size and shape that the protective member is attached to and retained in position by the under-cushioning members 13a,13a with the arms 43,43 frictionally engaging the opposed ends 17a,17a and with the coupled rows of fastener elements 33 received in the channel groove 39a as described for the protective member 22 of the first embodiment. The protective member 22a and the under-cushioning members 13a,13a are both made of an elastomeric material such as polyvinyl chloride or synthetic rubber.

Even if severe lateral forces tending to pull the butt-jointed fabrics 11,11 and hence the coupled stringer tapes 31,31 away from each other are applied, the butt-jointing of the fabrics 11,11 is positively maintained by virtue of the provision of the protective member 22(22a). This is true because in such a situation, the connecting portions 33a of each row of fastener elements 33 are brought into abutting engagement with the confronting side walls 46,46 of the groove 39(39a) to prevent disengagement or mismeshing of the coupled rows of fastener elements 33. Further, the provision of the protective member 22(22a) covering the coupled rows of fastener elements 33 ensures that no foreign matters such as dust, dirt or grit are introduced into the spaces between the fastener elements 33 which would otherwise adversely affect the manipulation of the slider to open and close the fastener and reduce the coupling strength of the fastener elements. This would result in disengagement or mismeshing of the coupled stringer tapes 31,31 with the resultant impairment of the butt-jointing of the fabrics 11,11.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A carpet construction comprising:

a. A pair of sheet materials having their opposed ends disposed in abutting engagement with each other;

b. a pair of undercushioning members secured respectively to reverse surfaces of said sheet materials, said undercushioning members terminating short of said abutting ends to provide a longitudinal recess therebetween;

c. a sliding clasp fastener having a pair of stringer tapes carrying along their inner longitudinal edges rows of interengageable fastener elements, said stringer tapes being secured to the reverse surfaces of said sheet materials immediately adjacent to the abutting ends thereof, said rows of fastener elements being coupled together, and said coupled rows of fastener elements being located in said longitudinal recess; and d. a protective member extending along the length of said sliding clasp fastener and covering said coupled rows of fastener elements, and said protective member having a longitudinal groove snugly receiving said coupled rows of fastener elements therein, thereby preventing the same from displacement in a direction transverse to the longitudinal axis of said sliding clasp fastener.

2. A carpet construction according to claim 1, in which said protective member includes a body of channel-shaped cross section having a pair of opposed arms and a base interconnecting said arms at one of their ends, said pair of arms frictionally engaging the opposed ends of said undercushioning members.

3. A carpet construction according to claim 1, in which said sliding clasp fastener is of the concealed type.

4. A carpet construction according to claim 1, further including a pair of attachment members each secured to the reverse surface of said sheet material and disposed intermediate said stringer tape and said undercushioning member, said attachment members retaining said protective member in position.

5. A carpet construction according to claim 4, in which said protective member has a pair of lateral projections extending along said arms, each of said attachment members has a depression formed in and extending along the undersurface thereof, and said lateral projections being complementary in shape to said depressions so as to be received therein.

* * * * *